US010638831B2

(12) United States Patent
Pilevsky et al.

(10) Patent No.: US 10,638,831 B2
(45) Date of Patent: May 5, 2020

(54) FLUID DISPENSING BRUSH

(71) Applicant: Shordee Products LLC, Woodsburgh, NY (US)

(72) Inventors: Dena Pilevsky, Woodsburgh, NY (US); David Farrage, Demarest, NJ (US)

(73) Assignee: SHORDEE PRODUCTS LLC, Cedarhurst, NY (US)

( * ) Notice: Subject to any disclaimer, the term of this patent is extended or adjusted under 35 U.S.C. 154(b) by 351 days.

(21) Appl. No.: 15/822,390

(22) Filed: Nov. 27, 2017

(65) Prior Publication Data

US 2018/0153295 A1 Jun. 7, 2018

Related U.S. Application Data

(63) Continuation-in-part of application No. 29/611,664, filed on Jul. 24, 2017, now Pat. No. Des. 844,331.

(60) Provisional application No. 62/402,305, filed on Sep. 30, 2016.

(51) Int. Cl.

| | |
|---|---|
| ***B43K 5/02*** | (2006.01) |
| ***A46B 11/00*** | (2006.01) |
| ***A46B 9/02*** | (2006.01) |

(52) U.S. Cl.

CPC ..... *A46B 11/0037* (2013.01); *A46B 9/023* (2013.01); *A46B 9/028* (2013.01); *A46B 11/00* (2013.01); *A46B 11/002* (2013.01); *A46B 2200/102* (2013.01)

(58) Field of Classification Search

CPC ... A46B 11/002; A46B 11/0037; A46B 9/028; A46B 2200/102

USPC ..... 401/188 R, 273

See application file for complete search history.

(56) References Cited

U.S. PATENT DOCUMENTS

| | | | | |
|---|---|---|---|---|
| 2,998,822 A | | 9/1961 | Birch et al. | |
| 3,147,757 A | | 9/1964 | Hofmann | |
| 4,319,852 A | | 3/1982 | Bell et al. | |
| 5,339,839 A | | 8/1994 | Forcelledo et al. | |
| 5,845,651 A | | 12/1998 | de Nervo | |
| 5,927,290 A | * | 7/1999 | Thiruppathi | A46B 11/0017 132/116 |
| 5,975,089 A | | 11/1999 | Simon | |
| 6,022,163 A | | 2/2000 | Asfur | |

(Continued)

FOREIGN PATENT DOCUMENTS

| | | |
|---|---|---|
| DE | 3743713 | 7/1989 |
| EM | 000291810-0003 | 4/2005 |

(Continued)

*Primary Examiner* — Jennifer C Chiang
(74) *Attorney, Agent, or Firm* — Stern & Schurin LLP

(57) ABSTRACT

A brush comprising a housing having an opening at which there is a pad and bristles. The housing defines an interior space and a handle. In the interior space, there is located a fluid reservoir, a pump assembly having a pump cylinder tube and plunger, and a piping array which are airtight and fluidly connected to one another. In a preferred embodiment, a plurality of silicone, duckbill ejection valves are provided at the ends of the piping array and are positioned on the pad among the bristles. To enable movement of fluid from the reservoir to and out of the ejection valves, an actuator lever is provided and adapted to be operated by a user. The actuator lever is adapted to move between a first position and a second position, creating a pumping action to dispense fluid through the ejection valves.

20 Claims, 10 Drawing Sheets

(56) References Cited

U.S. PATENT DOCUMENTS

| | | | | |
|---|---|---|---|---|
| 6,071,029 | A | 6/2000 | Weinstock | |
| 6,158,442 | A | 12/2000 | Piatetsky | |
| 6,213,129 | B1 | 4/2001 | Muldoon | |
| 6,672,313 | B2 * | 1/2004 | Battaglia | A46B 11/0017 132/112 |
| 6,974,092 | B1 * | 12/2005 | Leventhal | A46B 11/0017 239/302 |
| 7,011,468 | B1 * | 3/2006 | Leventhal | A45D 19/02 132/116 |
| 7,044,137 | B2 | 5/2006 | Glucksman et al. | |
| 7,055,528 | B2 * | 6/2006 | Shah | A45D 19/02 132/109 |
| 7,156,104 | B2 * | 1/2007 | Kennedy | A45D 19/02 132/208 |
| 7,475,688 | B2 | 1/2009 | Colacioppo et al. | |
| 7,722,278 | B2 * | 5/2010 | Black | A46B 11/002 401/286 |
| 7,814,917 | B2 * | 10/2010 | Hurwitz | A01K 13/002 132/112 |
| 8,398,325 | B2 * | 3/2013 | Wu | A46B 11/0006 401/188 R |
| D798,605 | S | 10/2017 | Funches | |
| D815,837 | S | 4/2018 | Zhou | |
| D832,591 | S | 11/2018 | Kuo | |
| 10,278,485 | B2 * | 5/2019 | Hohlbein | A46B 9/028 |
| 2004/0035435 | A1 | 2/2004 | Glucksman et al. | |
| 2004/0187883 | A1 | 9/2004 | Shah et al. | |
| 2007/0095362 | A1 * | 5/2007 | Koopah | A46B 7/04 134/1 |
| 2007/0144549 | A1 * | 6/2007 | Enriquez | A45D 24/28 132/116 |
| 2011/0299909 | A1 | 12/2011 | Madappattu | |
| 2015/0157108 | A1 | 6/2015 | Roberts | |
| 2017/0238679 | A1 * | 8/2017 | Caulier | A46B 9/021 |
| 2018/0228277 | A1 | 8/2018 | Pulfrey et al. | |

FOREIGN PATENT DOCUMENTS

| | | |
|---|---|---|
| EM | 002870584-0001 | 12/2015 |
| EM | 003067065-0003 | 5/2016 |
| EM | 003067065-0005 | 5/2016 |
| EM | 003111046-0001 | 5/2016 |
| EM | 003447218-0001 | 11/2016 |
| EM | 002752741-0001 | 2/2018 |
| EM | 001194484-0002 | 3/2018 |
| KR | 2000-0017091 | 9/2009 |

* cited by examiner

FLUID DISPENSING BRUSH

CROSS-REFERENCE TO RELATED APPLICATION

This U.S. nonprovisional patent application is a continuation in part of U.S. design application 29/611664, filed on Jul. 24, 2017, and also claims priority to U.S. provisional application 62/402,305, filed on Sep. 30, 2016. Each of these applications are incorporated by reference herein in their entireties.

TECHNICAL FIELD

The present invention relates to a brush, and more particularly, to a fluid dispensing brush.

BACKGROUND OF THE INVENTION

Several hair brushes and applicators have been created and disclosed in the prior art for use in applying liquids, such as gel, conditioners, hair coloring and other hair products to human hair. For example, U.S. Pat. No. 5,975,089 ("the '089 patent") discloses a hair brush applicator for applying 'flowable' hair care products such as gel and conditioner to the hair of a user. The hair brush of the '089 patent comprises a handle with a chamber that is connected to the head of the hair brush, having a number of narrow and wide bristles extending from the brush. The wide bristles are tubular and have open roots and lateral apertures positioned between the root and tip of the bristle. A rotating disk is provided to fluidly connect the chamber in the handle to the wide bristles. The handle comprises a flexible bellows region which permits squeezing of the handle to compress the chamber to force the hair care product to flow through the bristles. Notwithstanding the intended utility, the use of tubular applicators is inefficient and difficult to clean. When hair product such as gel dries over time inside the tubular bristle, it is time consuming and challenging to clean and remove the gel in order to clear the path for future flow. This renders the hair brush progressively less effective after each use. Furthermore, dispensing hair care products through bristles is inefficient since the scalp hinders the even flow of hair care product to and through the hair.

Similarly, U.S. Pat. No. 6,071,029 ("the '029 patent") discloses a gel dispensing hair brush having a number of hollow bristles tapering from the head of the brush to a free end at the tip of the bristle for dispensing gel that is held within a reservoir in the head of the brush. The device includes a compression plate which compresses the bellows in the head of the brush when a thumb wheel is rotated. As the bellows compress, gel is forced through a dispensing plate through to the hollow bristles for application to hair. As with the '089 patent, this device (i) may be difficult to clean and degrade over time if gel dries in the hollow bristle and (ii) will not efficiently distribute the hair care product to the hair as the scalp will block the end of the bristles.

Another patent, U.S. Pat. No. 4,319,852 ("the '852 patent") discloses a dispensing brush having a rigid holding chamber and a deformable bulb attached to the chamber for pressurizing the chamber. In order to dispense material from within the chamber, an operator may use his/her thumb to depress the bulb and increase the air pressure within the holding chamber so as to eject treatment material from the chamber through a plurality of dispensing orifices extending through the bristle retaining portion of the brush. Although effective at forcefully ejecting material from within the chamber, it is difficult to regulate the amount of material being ejected leaving a user desiring more or less than the amount actually ejected.

SUMMARY OF THE INVENTION

In view of the drawbacks of the prior art, it is a primary objective of the present invention to provide an improved hair brush and applicator for applying gel and/or other hair products to the hair of a user.

It is another objective of the present invention to provide an improved hair brush and applicator that dispenses and applies a more precise, measured amount of gel and/or other hair products to the hair of a user.

It is a further objective of the present invention to provide an improved hair brush and applicator that is easy to clean and refill with liquids or hair products, as desired.

According to an exemplary embodiment of the present invention, there is disclosed a brush formed of a first casing having a first opening with a pad and bristles, and a second casing engaged to the first casing which together define an interior space and a handle. Alternatively, in place of a first casing and second casing which combine with one another, an elongated hollow member with access points to an interior space may be utilized. In the interior space, there is located a fluid reservoir, a pump assembly and a piping array which are fluidly connected to one another. A plurality of ejection valves is also provided and fluidly connected to the piping array and positioned on the pad among the bristles. To enable movement of fluid from the reservoir to the ejection valves, an actuator lever is provided and adapted to be operated by a user. The actuator lever is adapted to move between a first position and a second position, creating a pumping action to dispense fluid through the ejection valves.

Additional features of the improved hair brush and applicator are described below in more detail.

BRIEF DESCRIPTION OF THE DRAWINGS

The above and other features and aspects of the present invention will become more apparent by describing in detail exemplary embodiments thereof with reference to the accompanying drawings, in which.

DETAILED DESCRIPTION OF THE EMBODIMENTS

Figure 1:
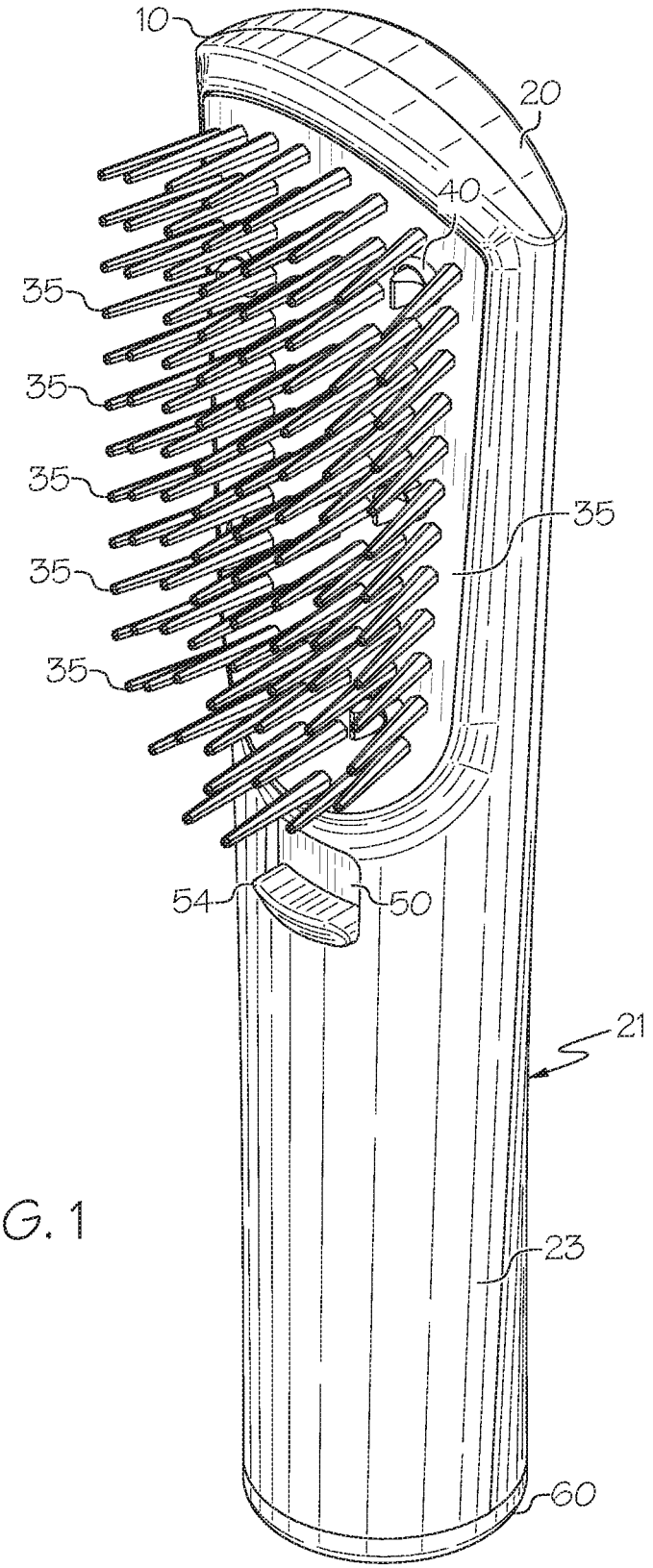
FIG. 1 is a perspective view illustrating a fluid dispensing brush according to an exemplary embodiment of the present invention.

Exemplary embodiments of the present invention will be described more fully hereinafter with reference to the accompanying drawings, FIGS. 1 through 12. The present invention may, however, be embodied in different forms and should not be construed as limited to the embodiments set forth herein. Like reference numerals may refer to like elements throughout the specification. The sizes or proportions of elements illustrated in the drawings may be exaggerated for clarity. When an element is described as being on another element, the element may be directly disposed on the other element or intervening elements may be disposed therebetween.

The present invention relates to an airless brush that dispenses fluids (e.g., gel, conditioners) from ejection valves when moving an actuator lever from a first position to a second position. In a preferred embodiment, fluid contained within the brush is prevented from being exposed to air while stored inside of the brush until the fluid is dispensed from the ejection valves (which are substantially airtight). Thus, the fluid is hindered from drying, evaporating and/or oxidizing while stored within the brush (e.g., within the dispensing mechanism of the brush) because the internal components of the brush are airtight (or substantially airtight).

Referring to FIGS. 1 to 9, in an exemplary embodiment of the present invention, the brush comprises a top casing 10 and a bottom casing 20 which together form a housing 21 and handle 23. Housing 21 defines a large interior space, that may be further divided into smaller interior spaces, within which several components described herein are located. It should be appreciated and understood that housing 21 which is defined by top casing 10 and bottom casing 20 may alternatively be formed of a single integrally molded casing, or elongated hollow member, with appropriately sized openings and/or access points instead of the interlocking top casing 10 and bottom casing 20 as described herein, while still keeping within the spirit and scope of the present invention.

The brush further comprises a pad 30 with bristles 35, one or more ejection valves 40, an actuator lever 50, a ring cap 60, a cover or lid 70 (see FIGS. 7 and 8) and a fluid dispensing mechanism or apparatus. The fluid dispensing mechanism is predominantly disposed within the housing 21 that, in the preferred embodiment disclosed herein, is defined by the top casing 10 and bottom casing 20.

Figure 8:
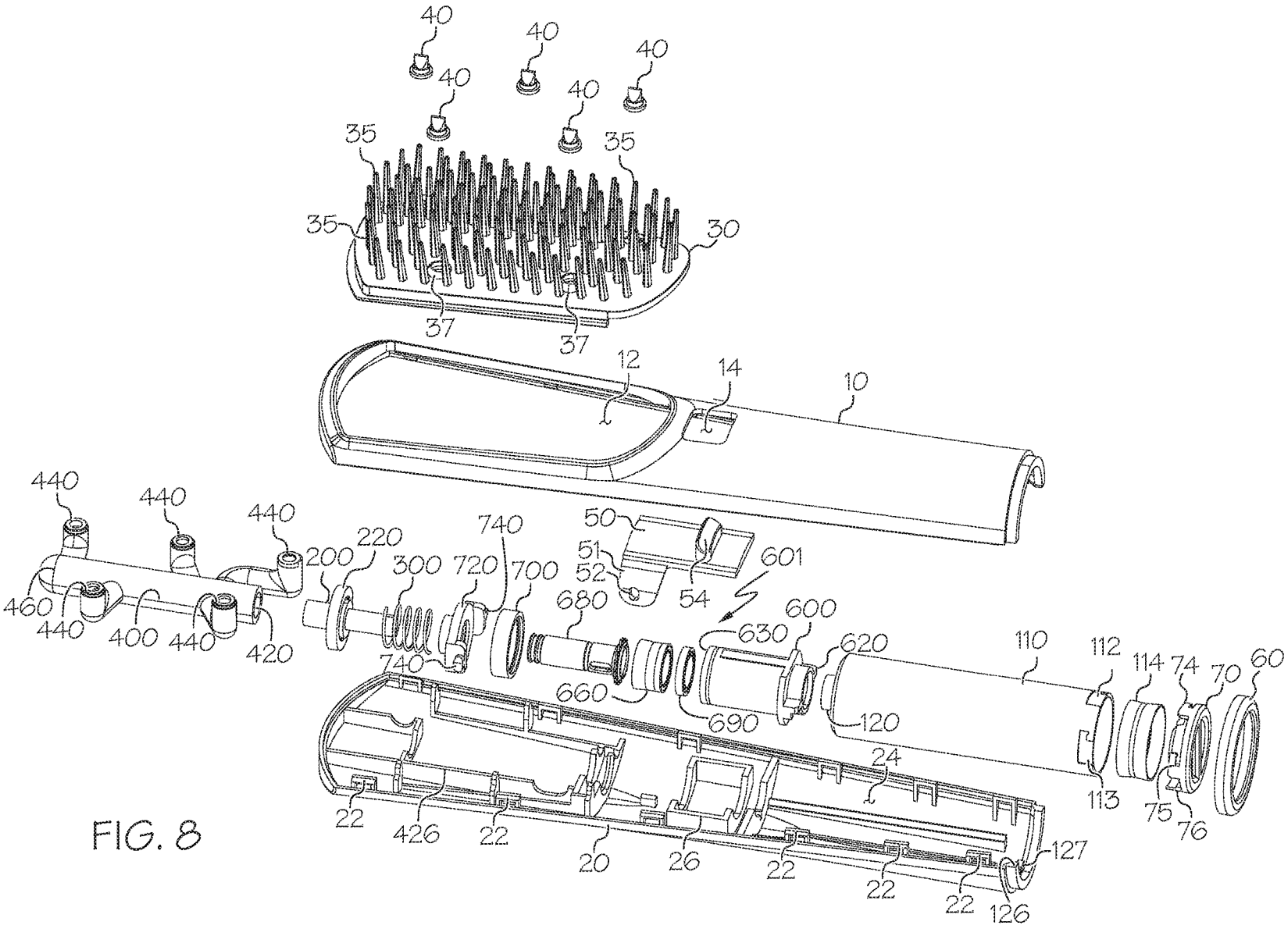
FIG. 8 is an exploded perspective view illustrating a fluid dispensing brush and its constituent parts according to an exemplary embodiment of the present invention.

Referring to FIG. 8, in an exemplary embodiment of the present invention, top casing 10 includes a first opening 12 and a second opening 14. First opening 12 accommodates pad 30 with bristles 35, while second opening 14 accommodates actuator lever 50. Actuator lever 50 moves and/or slides in a longitudinal direction of the brush within second opening 14. Actuator lever 50 includes a textured thumb press 54 protruding from second opening 14.

Top casing 10 may be constructed from a number of different materials, such as plastic(s), metal(s) and/or wood. In an exemplary embodiment of the present invention, top casing 10 may be a soft touch coated Acrylonitrile Butadiene Styrene (ABS) injection molded part. However, the present invention is not limited thereto. Bottom casing 20 may be constructed from the same material(s) as the top casing 10 or different materials, as desired. When a single hollow member is utilized in place of casings 10, 20, the same materials may be utilized to form the hollow member.

Top casing 10 and bottom casing 20 may be affixed or engaged to each other, for example, by using a plurality of snaps 22 (see FIG. 8), screws, glue, or other conventional fastening mechanisms. As shown in FIG. 8, snaps 22 of bottom casing 20 are configured to snap in place with (or snap into) corresponding snap members of top casing 10 such that top casing 10 and bottom casing 20 are securely fastened to one another. For example, snaps 22 may be detachably interlocked with each other, or other detachable locking mechanisms may be used. It is understood that the number, type and arrangement of the snaps 22 and the snaps of the top casing 10 may vary as desired.

According to an exemplary embodiment of the present invention, the brush illustrated in FIGS. 1 to 9 may be self-standing (e.g., the brush may stand upright) when resting on cap 60 and/or lid 70. Cap 60 and/or lid 70 may provide a flat supporting base for the brush to be self-standing.

Each of the first casing 10 and second casing 20 may have an elongated and curved indentation or ledge at a respective first end thereof. The indentation or ledge at each first end of casings 10, 20 accommodates a cap 60 such that when cap 60 is disposed at the aforementioned indentations, casing 10, casing 20 and cap 60 form a continuous profile of the brush. Cap 60 is intended to prevent separation of the ends of top casing 10 and bottom casing 20 from one another and to keep them in mating engagement.

Cap 60 may be constructed of a plastic, a metal (e.g., aluminum), or other conventional material known in the art. In an exemplary embodiment of the present invention, cap 60 may include the same material as casing 10 and/or casing 20.

Lid 70 enables or prevents access to a chamber 24 for insertion or removal of a fluid reservoir or container 110 into chamber 24. Chamber 24 is a space defined, in part, by the internal curvature of casings 10, 20. It should be understood that chamber 24 may be modified as needed to accommodate smaller or larger fluid reservoirs or containers.

In a preferred embodiment, lid 70 is configured to be rotationally engaged with fluid reservoir 110 in order to secure fluid reservoir 110 within chamber 24. Rotational engagement may be achieved through threaded grooves with mating members or other conventional attachments and means known in the art. In addition, lid 70 may be rotated and pulled in a direction away from chamber 24 to remove fluid reservoir 110 from chamber 24.

Referring to FIG. 8, lid 70 comprises teeth or first hooked members 74, 75, which engage openings or channels 112, 113 of fluid reservoir 110. When fluid reservoir 110 is inserted in chamber 24, lid 70 is inserted through the internal opening defined by cap 60 such that first hooked members 74, 75 are inserted into corresponding channels 112, 113. Lid 70 also fastens to one or both casings 10, 20 via mechanical latching or interlocking attachments 76, 126 located on lid 70, and casing 20, respectively. Thus, once teeth or first hooked members 74, 75 are positioned in the openings of channels 112, 113, lid 70 is rotated in a first direction (e.g., clockwise) to a locking position to securely fasten lid 70 inside channels 112, 113 and to fasten lid 70 to casing 20 via mechanical latching attachments 76, 126. Mechanical latching attachments 76, 126 are constructed and function similarly to first hooked members 74, 75 and channels 112, 113. In a preferred embodiment, a second hooked member 76, which is curved to conform to the internal curvature of casing 24, forms a space or groove within which a projection 127 on casing 20 is positioned when lid 70 is rotated into a locking position. When lid 70 is locked into place, fluid reservoir 110 is prevented from being ejected from chamber 24.

Preferably, three teeth or hooked members in the form of first hooked members 74, 75 are utilized to secure lid 70 to reservoir 110. However, it should be appreciated and understood that more or fewer may be employed to lock lid 70 to reservoir 110. By the same token, more than one set of mechanical latching attachments 76, 126 may be utilized to secure lid 70 to one or both casings 10, 20.

To remove fluid container or reservoir 110 from chamber 24, lid 70 is rotated in a second direction opposite to the first direction. When lid 70 is rotated in a second direction (e.g., counterclockwise) to an unlocking position, second hooked member 76 rotates so that projection 127 is no longer positioned in the groove formed by second hooked member 76. Simultaneously, rotation of lid 70 in the second direction simultaneously rotates first hooked members 74, 75 back to the original insertion position of the openings to channels 112, 113. At this state, lid 70 may be pulled out. In a preferred embodiment, when lid 70 is pulled out, lid 70 may simultaneously pull out fluid reservoir 110 from chamber 24 via the ongoing engagement of lid 70 with fluid container 110. To achieve this result, straightforward modifications of channels 112, 113 may be made in order to achieve persisting engagement between of first hooked members 74, 75 and fluid container 110 even after mechanical latching attachments 76, 126 are in an unlatched position. In this configuration, lid 70 and fluid reservoir 110 would have a "2-stage lock"—one "lock" which fastens lid 70 to one or both of casing 10, 20 and another "lock" which fastens lid 70 to fluid reservoir 110.

It should be appreciated an understood that the directions of rotations discussed herein may be reversed. In addition, the degree of rotation in the first and second directions may be predetermined (e.g., 30 degrees, 90 degrees or 30-180 degrees, etc.).

In a preferred embodiment, lid 70 may have one or more through holes to allow air flow between chamber 24 and the environment that is external to the brush. Thus, pressure cap 114 of fluid container 110 may freely move within the fluid container 110, particularly in the forward direction towards pump assembly 601 as fluid is drawn out of fluid container 110.

Figure 7:
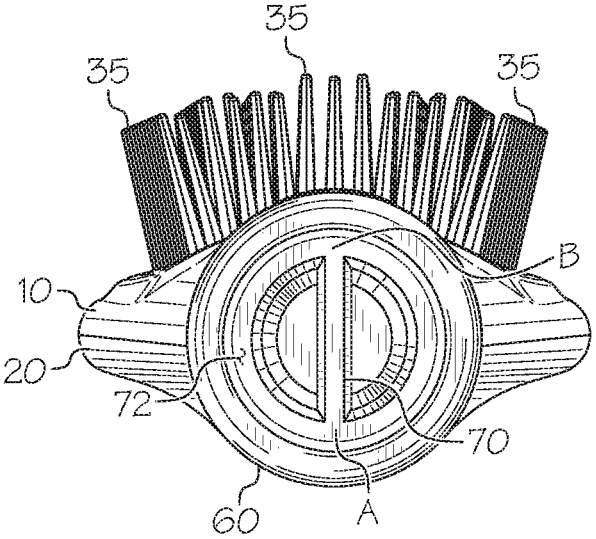
FIG. 7 is a side view illustrating a fourth side (rear) of a fluid dispensing brush according to an exemplary embodiment of the present invention.

Referring to FIG. 7, lid 70 may include curved member 72 (e.g., approximately a half-circular member) which is positioned about points A and B such that curved member 72 may be pulled out from a stowed or pushed-in state. Curved member 72 is flush with lid 70 to which it is attached when in the stowed state, as shown in FIG. 8. When curved member 72 is pulled out from its stowed state to a protruding state, a user's finger or other object may be inserted between lid 70 and curved member 72 to rotate, push and/or pull lid 70. Curved member 72 may be frictionally- or snap-engaged with the lid 70 to prevent the curved member 72 from rotating about points A and B due to its own weight when the brush is moved/rotated.

Figure 9:
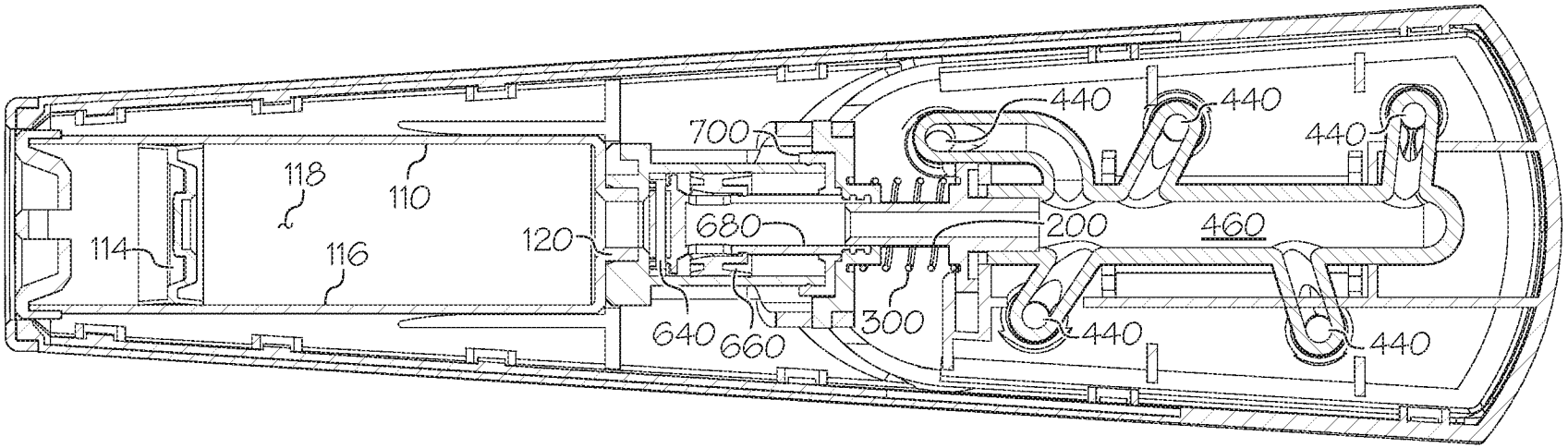
FIG. 9 is a cross-sectional view taken along line 9-9 of FIG. 4, according to an exemplary embodiment of the present invention.
Figure 10:
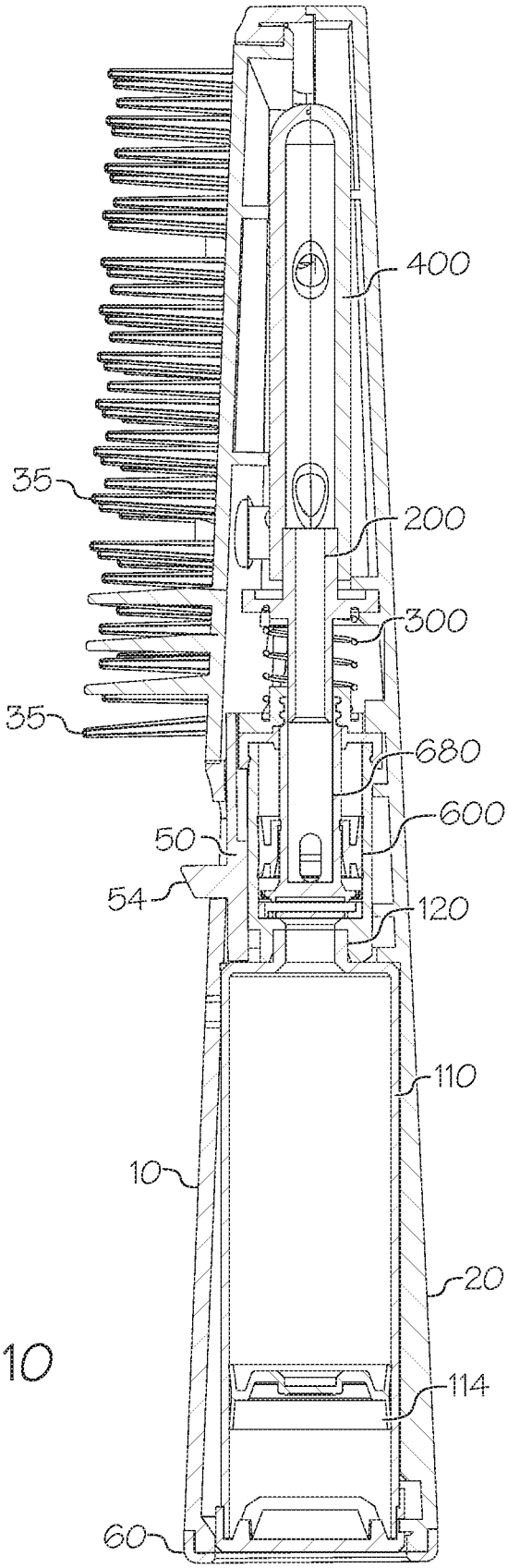
FIG. 10 is a cross-sectional view taken along line 10-10 of FIG. 2, according to an exemplary embodiment of the present invention.

According to an exemplary embodiment of the present invention, and with reference to FIGS. 8, 9 and 10, the dispensing mechanism of the brush includes all internal components of the brush that contribute to the holding, movement and dispensing of fluid from fluid container 110 to valves 40. Most notably, the dispensing mechanism of the brush comprises reservoir 110, pump assembly 601, flange tube 200 connected to pump assembly 601, a spring 300 disposed between flange tube 200 and pump assembly 601, feeder tube or piping array 400 connected to flange tube 200 and one or more ejection valves 40.

Fluid reservoir 110, pump assembly 601, feeder tube 400 and the one or more ejection valves 40 are most preferably in fluid and airtight communication with each other. When actuator lever 50 is moved from a first position (i.e., distant to pad 30) to a second position (i.e., adjacent to pad 30), fluid stored in fluid reservoir 110 is suctioned from fluid reservoir 110 and flows into the pump assembly 601 to fill pump assembly 601. Simultaneously, while actuator lever 50 is moved from the first position into the second position, fluid that was already stored in the pump assembly 601 is pushed forward by pump assembly 601 to flow towards flange tube 200, from flange tube 200 into the feeder tube or piping array 400, and from the feeder tube or piping array 400 outside of the brush through the one or more ejection valves 40.

When actuator lever 50 is released, spring 300 pushes and causes actuator lever 50 to move back to the first position. No fluid is pushed back from pump assembly 601 into the fluid reservoir 110 when lever 50 moves from the second position back into the first position due to valve 690 disposed inside of pump tube 600 of pump assembly 601.

Referring to FIGS. 8 and 9, fluid reservoir 110 preferably comprises a pressure cap 114, configured to slide on inner wall 116 with low friction, to seal the fluid stored in a storage room 118 from air. Thus, when fluid is suctioned off from the storage room 118 by the pump assembly 601, pressure cap 114 moves toward an ejection end 120 of fluid reservoir 110. Pressure cap 114 forms a double perimeter seal by two molded feathered edges (e.g., tapering edges), as shown in FIGS. 8, 9 and 10. However, the present invention is not limited thereto, and the pressure cap may also include a single perimeter seal, or a triple (or more) perimeter seal.

Referring to FIGS. 8, 9 and 10, in a preferred embodiment, a pump assembly 601 comprises a pump tube 600, having a first end 620, second end 630 and a hollow member disposed between first and second ends 620 and 630. Pump assembly 601 further comprises a valve 690 disposed inside of pump tube 600 at said first end 620 of pump tube 600, a plunger 680 disposed within pump tube 600, a gasket 660, a cylinder cover 700 and a plunger cover 720. Preferably, pump tube 600 is fixed relative to casings 10, 20 by a molding 26, as shown in FIG. 8. A similar piping array molding 426 is provided to stabilize and support piping array 400 during use and handling of the brush.

The coupling between ejection end 120 of fluid reservoir 110 and first end 620 of pump tube 600 is preferably airtight. Although in a preferred embodiment ejection end 120 is inserted into first end 620 of pump tube 600, several other conventional modes of mechanical connection may be achieved. For example, a larger ejection end may be constructed such that the first end of a pump tube is inserted into the ejection end of the modified reservoir. Likewise, a sleeve and/or gasket may be utilized to connect the ejection end of the reservoir and first end of the pump tube.

Figure 12:
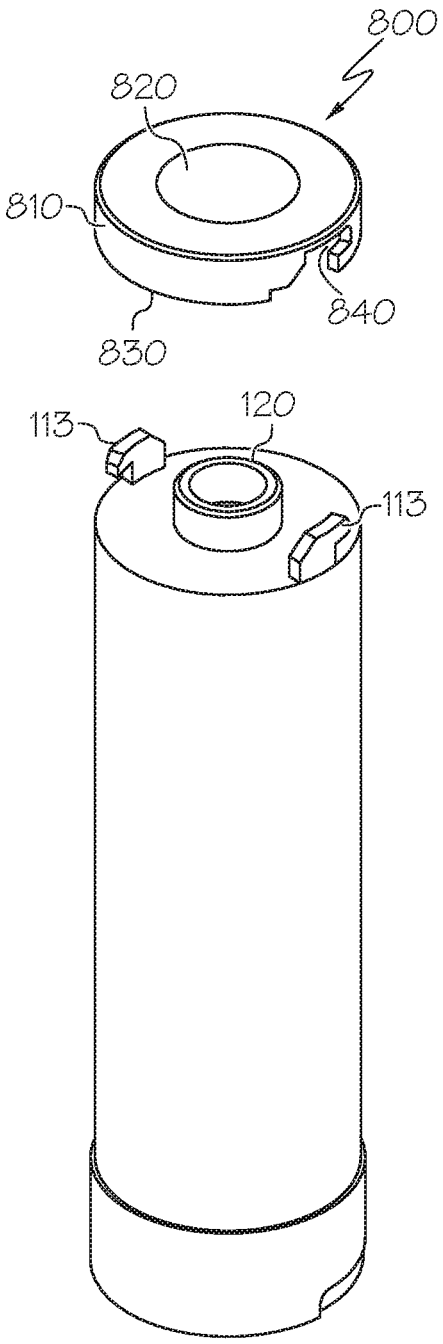
FIG. 12 is a perspective view illustrating a fluid container and a tube cover, according to an exemplary embodiment of the present invention.

According to an alternate exemplary embodiment of the present invention, as depicted in FIG. 12, fluid reservoir 110 may be configured to be coupled to a tube cover 800. Tube cover 800 may cover and/or protect ejection end 120 of fluid container 110. In this embodiment, fluid container 110 includes a pair of L-shaped protrusions or third hooked members 113, 113 flanking ejection end 120. L-shaped protrusions 113, 113 may be disposed, for example, at diametrically opposite ends of fluid container 110. Each of the L-shaped protrusions 113 may be similar to, for example, first hooked members 74, 75. The pair of L-shaped protrusions 113, 113 may be used to engage and affix tube cover 800 to fluid container 110 by rotating the tube cover 800 relative to the fluid container 110 in a first direction. Tube cover 800 may be disengaged from the fluid container 110 by rotating the tube cover 800 relative to the fluid container 110 in a second direction opposite to the first direction.

Tube cover 800 includes a hollow member 810 with a first closed or covered end 820 and a second opened end 830 opposite to the first end 820. Hollow member 810 of tube cover 800 preferably embodies a size (e.g., diameter) that is substantially equal to the size (e.g., diameter) of fluid container 110. Hollow member 810 of tube cover 800 includes a pair of openings 840, for example, a pair of mating L-shaped openings 840 adapted to be engaged with the L-shaped protrusions 113, 113 of fluid container 110. Thus, tube cover 800 is be engaged to fluid container 110 when rotating the tube cover 800 in the first direction to engage the pair of L-shaped openings 840 with L-shaped protrusions 113, 113. In addition, tube cover 800 may be disengaged from fluid container 110 when rotating tube cover 800 in the second direction to disengage the pair of upside-down L-shaped openings 840 from the pair of L-shaped protrusions 113, 113. When utilized, the pair of L-shaped protrusions 113, 113 do not prevent fluid container 110 from being engaged with pump tube 600. In other words, the pair of L-shaped protrusions 113, 113 does not interfere with pump tube 600.

Referring to FIG. 8, cylinder cover 700 seals pump tube 600. For example, cylinder cover 700 seals the second end 630 of pump tube 600. Valve 690 (e.g., internal valve) enables fluid to flow from the fluid reservoir 110 into pump tube 600 and to prevent fluid from flowing from the pump tube 600 back into fluid container 110.

Gasket 660 is preferably disposed between an inner wall of the pump tube 600 (i.e., an inner wall of the hollow member of pump tube 600) and plunger 680. Gasket 660 is intended to create an airtight (or substantially airtight) movable seal between the inner wall of pump tube 600 and plunger 680 by contacting both the inner wall of the pump tube 600 and the plunger 680. Plunger 680 is inserted into an opening of the gasket 660. Gasket 660 may move longitudinally between valve 690 and cylinder cover 700.

Plunger 680 has a first end disposed within pump tube 600 and a second end connected to the plunger cover 720. Plunger 680 may extend in the same direction in which actuator lever 50 slides during use. Plunger 680 pushes or pumps fluid toward ejection valves 40 via piping array 400 when actuator lever 50 is moved toward the pad 30 by a user exerting forward force on actuator lever 50. Plunger cover 720 is disposed between the cylinder cover 700 and flange stopper 220 of the flange tube 200.

In a preferred embodiment, flange tube 200 comprises a hollow elongated housing having a first end extended inside of the second end of the plunger 680 to create a slidable and airtight (or substantially airtight) connection between the flange tube 200 and plunger 680, a second end having an airtight (or substantially airtight) connection with feeder tube or piping array 400, and flange stopper 220 disposed between the first and second ends of flange tube 200. Spring 300 has a first end resting on (i.e., pressing against) flange stopper 220 and a second end resting on plunger cover 720. It is understood that flange tube 200 is stationary and plunger 680 moves relative to flange tube 200 during use and actuation of actuator lever 50.

Plunger 680 is adapted to move longitudinally together with actuator lever 50 when actuator lever 50 is moved between a first position and second position. In a preferred embodiment, plunger 680 comprises a first central axis, which is in line with the central axis of pump tube 600 and central axis of flange tube 200. According to an exemplary embodiment of the present invention, plunger 680 includes a pair of lateral openings adjacent to the first end thereof, as shown in FIGS. 8, 9 and 10.

In an exemplary embodiment of the present invention, actuator lever 50 includes a housing that extends in the same direction as the first central axis, and a pair of arms 51 each having a hole 52. The housing of actuator lever 50 is disposed between top casing 10 and pump assembly 601. Holes 52 are coupled to respective bosses 740, 740 of plunger cover 720 to connect actuator lever 50 to plunger 720. Thus, plunger cover 720 connects the plunger 680 to actuator lever 50. It should be understood and appreciated that the connection of the plunger cover 720 to actuator lever 50 may be modified in a number of ways by taking into account the available space between casings 10, 20 and other internal components of the brush. For example, the number of bosses and holes and the number and configuration of arms of the actuator lever may be modified in a number of ways without departing from the spirit and scope of the present invention.

When actuator lever 50 is moved in the first direction towards pad 30, plunger cover 720 and plunger 680 are simultaneously moved in the same direct which simultaneously compresses spring 300 since plunger cover 720 is fixedly connected to the second end of the plunger 680. It is understood that the moving of actuator lever 50 in the first direction may be accomplished by pushing a thumb press 54 in the first direction. When actuator lever 50 is released, spring 300 decompresses, forcing plunger cover 720, plunger 680 and actuator lever 50 in a second, opposite direction towards cap 60.

The second end of flange tube 200 is preferably directly connected to an inlet 420 of feeder tube or piping array 400. For example, the second end of the flange tube 200 may be inserted into the inlet 420. However, other connection configurations may be used to create an airtight connection between flange tube 200 and feeder tube 400, through to the fluid container 110 via pump tube 600.

Figure 2:
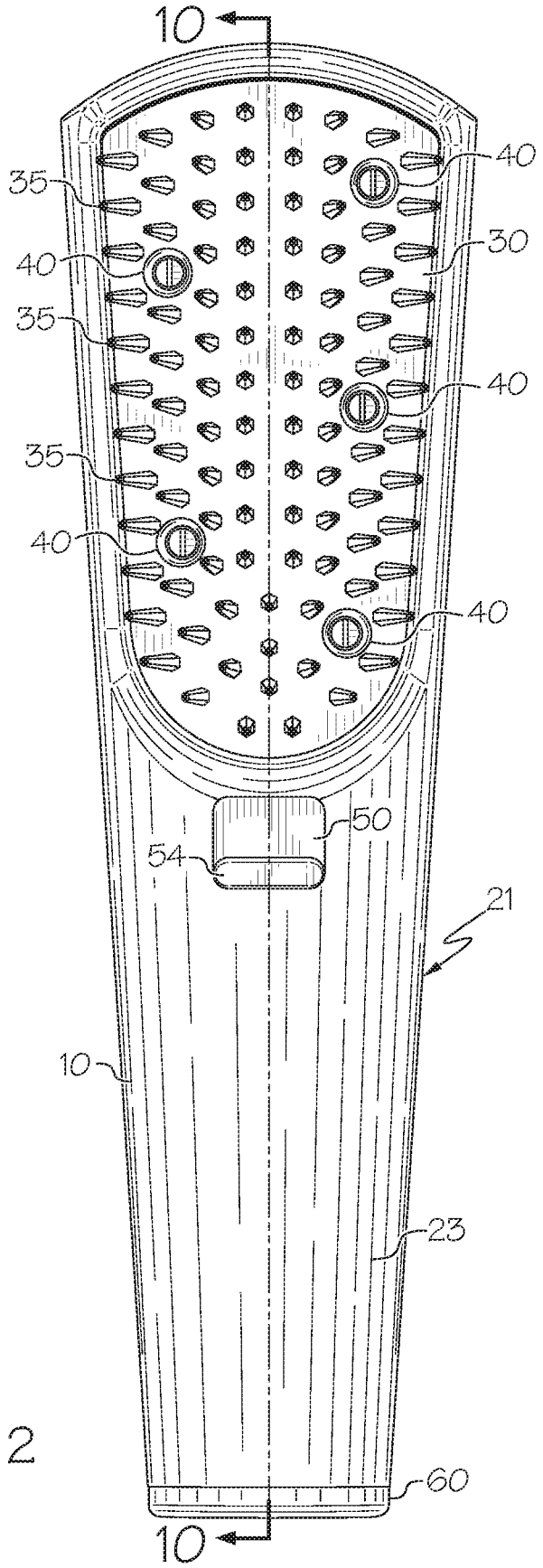
FIG. 2 is a plan view illustrating the top side of a fluid dispensing brush according to an exemplary embodiment of the present invention.
Figure 3:
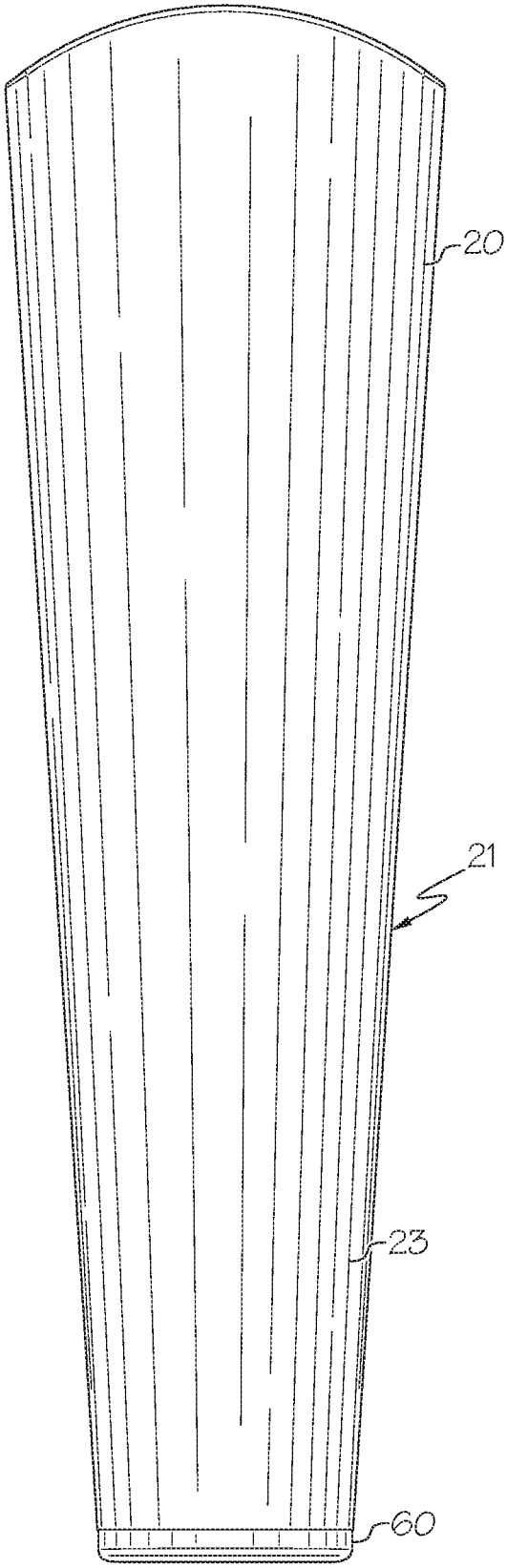
FIG. 3 is a plan view illustrating the bottom side of a fluid dispensing brush according to an exemplary embodiment of the present invention.
Figure 4:
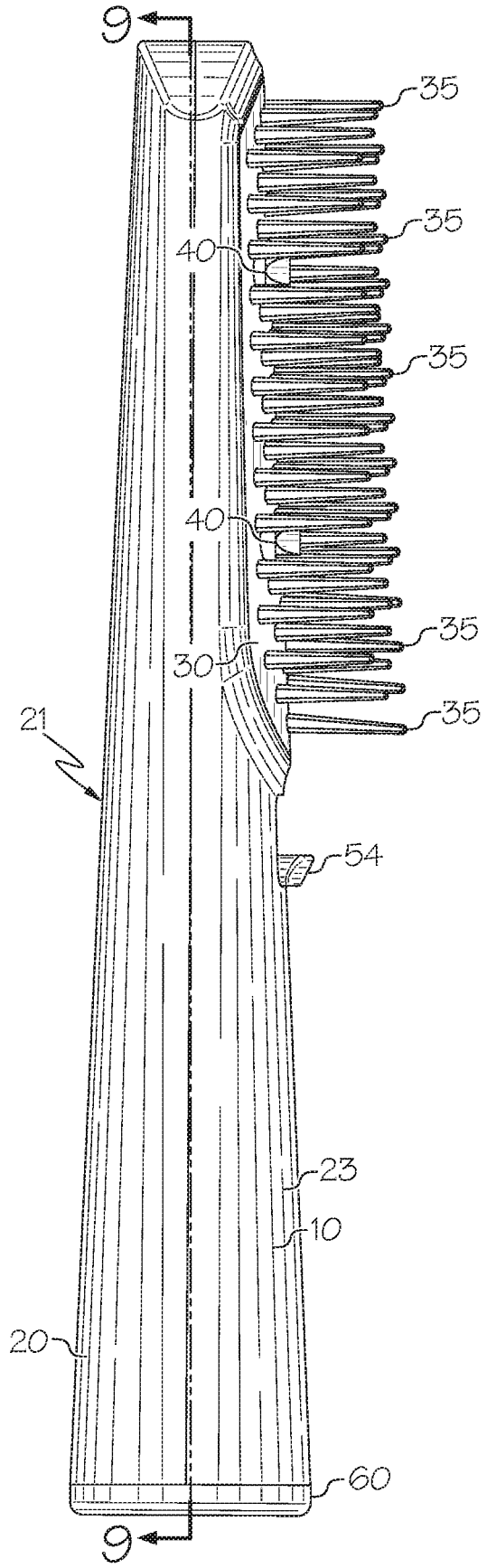
FIG. 4 is a side view illustrating a first side (left) of a fluid dispensing brush according to an exemplary embodiment of the present invention.
Figure 5:
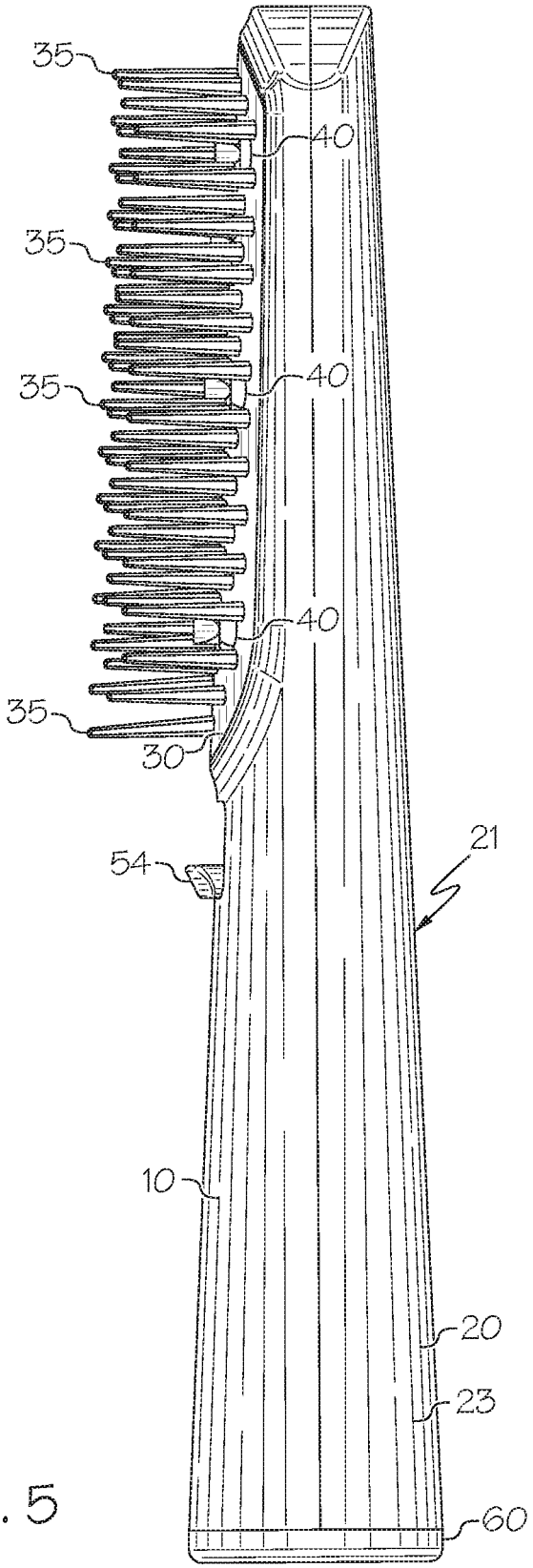
FIG. 5 is a side view illustrating a second side (right) of a fluid dispensing brush according to an exemplary embodiment of the present invention.
Figure 6:
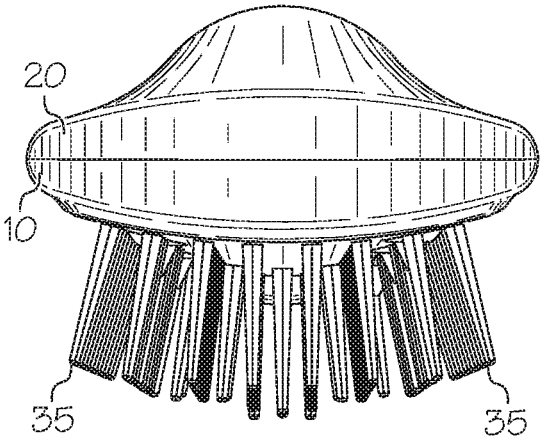
FIG. 6 is a side view illustrating a third side (front) of a fluid dispensing brush according to an exemplary embodiment of the present invention.

Feeder tube 400 preferably includes at least one outlet 440 and a main distribution line 460, as shown in FIG. 9, connecting inlet 420 with the at least one outlet 440. According to an exemplary embodiment of the present invention, feeder tube 400 includes a plurality of outlets 440 connected to the main distribution line 460. The dimensions and shapes of the connecting tubes that connect the main distribution line 460 with the outlets 440 may be such that the ejection valves 40 have an equal or substantially equal fluid outflow. Most preferably, the intended function and configuration of the dispensing mechanism and pump assembly 600 is to pump and dispense fluid via each of the valves simultaneously and preferably in substantially equal amounts as fluid is pumped with actuator 50. Thus, an intended, although not limiting, consequence of the dispensing mechanism is for all valves 40 to release fluid at the same (or substantially the same) time and in the same (or substantially the same) volume measurements. As depicted in FIG. 2, ejection valves 40 may be evenly distributed along the surface area of the pad 30 so that the brush may evenly distribute the fluid onto the desired target. Alternatively, other configurations, both symmetrical and asymmetrical can be utilized.

In a preferred embodiment, ejection valve 40 is constructed of silicon, rubber, or other flexible material. Ejection valve 40 may be, for example, a duckbill valve. A duckbill valve may include rubber or a synthetic elastomer, and may be shaped like the beak of a duck. For example, in a closed position, the duckbill valve may have a tapering end. Whether a duckbill valve or another type of valve is utilized, ejection valve 40 is most preferably a self-closing and airtight one-way valve which permits the fluid to flow out from feeder tube or piping array 400. Thus, after releasing fluid, ejection valve 40 can be washed while preventing the fluid contained inside from being exposed to or mixed with water, washing agents or air. Thus, pad 30 and bristles 35 may be cleaned or rinsed easily without diluting or contaminating the fluid inside the brush. Likewise, fluid insider the brush is prevented from drying out, evaporating or oxidizing.

Pad 30 includes a hole 37 for each ejection valve 40. Each ejection valve 40 may be connected to a corresponding outlet 440 through a respective hole 37. The ejection vales 40 most preferably each have an airtight connection with outlets 440. It should be appreciated and understood that the brush may be constructed without a separate pad element while still leaving holes or access areas to accommodate ejection valves and bristles in the surface of the housing.

Figure 11:
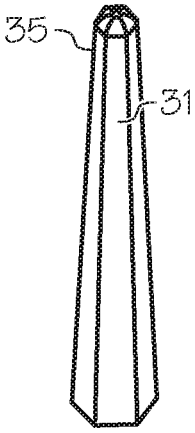
FIG. 11 is a perspective view illustrating a bristle of a fluid dispensing brush according to an exemplary embodiment of the present invention.

Referring to FIG. 11, each bristle 35 has an elongated hexagonal shaft or body 31 with a cross-section that gradually tapers as each bristle extends upward and away from pad 30. The hexagonal body shape allows the bristles 35 to efficiently glide through hair. Bristle 35 may have a solid or hollow cross-section. Bristles 35 also each comprise a hexagonal pyramid tip. However, it is understood that the tip of each of the bristles 35 may have other shapes such as a round or curved shape, a flat plate shape, or the bristles 35 may have a concave end. For example, a bristle may have a spherical tip. In addition, it should be appreciated and understood that bristles 35 are not limited to a hexagonal cross-section. For example, bristles may have sides, may have a partially flat and partially curved cross-section, or may have a different polygonal cross-section.

According to an exemplary embodiment of the present invention, pad 30 and bristles 35 may be manufactured together as one integral and continuous structure (e.g., as one piece) to reduce manufacturing costs. Each of the pad 30 and bristles 35 may be formed utilizing plastic, metal and/or wood or other conventional materials known in the art. In addition, pad 30 and/or the bristles 35 may be elastic, partially rigid or rigid.

Pad 30 with bristles 35 may be formed by using a mold having the desired shape and/or size of pad 30 and bristles 35. The mold may be filled with a flowable plastic and/or metal to form the pad 30 with bristles 35. Pad 30 with bristles 35 may be interchangeable or removable so that the same brush may be used with different pads 30 with bristles 35 for different hair types or styles.

The tips of bristles 35 may be formed, for example, by dipping a first end of each bristle 35 into resin, for example, a nylon resin. The first end of a bristle 35 may be distal to the pad 30. In addition, according to an exemplary embodiment of the present invention, the tip of each bristle 35 may be over-molded in place. For example, once that a bristle 35 is manufactured by a first manufacturing process, the tip of the bristle 35 may be molded over the first end of the bristle 35 (or molded onto the first end of the bristle 35) by a second manufacturing process. Over-molded bristle tips may be durable and securely attached to the first end of the bristles 35, and may have the above-referenced shapes.

In an exemplary embodiment of the present invention, pad 30 and bristles 35 may be manufactured separately. In this case, the individual bristles 35 may be inserted into holes of the pad 30 and may be fastened to the pad 30 through their respective holes. When manufacturing the pad 30 separately from the bristles 35, a first mold may be used to form the pad 30 with the holes 37 and with or without the holes for the bristles 35, and a second mold may be used to form at least one bristle 35.

Lid 70 and cap 114 may each be constructed using plastic, rubber, metal and/or wood or other conventional materials known in the art. The sealing edge(s) of the pressure cap 114 may be flexible. Each of the fluid container 110, the pump tube 600, the actuator lever 50, the valve 690, the plunger 680, the cylinder cover 700, the plunger cover 720, the flange 200 and the feeder tube 400 may be constructed of plastic, rubber, and/or a metal, or other conventional materials known in the art. The sealing edge(s) of the gasket 660 may be flexible. The spring 300 may include be elastic and may include a metal or plastic or other conventional materials known in the art.

It is understood that the pressure cap 114 insulates the fluid inside of the fluid container 114 from air. In addition, each connection between fluid reservoir 110 and pump tube 600, the connection between the pump tube 600 (as sealed by the cylinder cover) and the plunger 680, the connection between the plunger 680 and the flange 200, the connection between the flange 200 and the feeder tube 400, and the connection between the feeder tube 400 and the one or more ejection valves 40 is preferably airtight (or substantially airtight). Thus, the fluid can flow from the fluid container 100 to the exterior of the one or more ejection valves 40 without coming into contact with air. Such an airtight system prevents the fluid from drying inside of the above-listed components of the brush.

According to an exemplary embodiment of the present invention, fluid reservoir 110, pump tube 600, plunger 680, flange tube 200 and piping array 400 (particularly the main distribution line 460 thereof) move the fluid along the same axis. In other words, the center of fluid reservoir 110, the center of pump tube 600, the center of plunger 680, the center of flange tube 200 and the center of piping array 400 are disposed along the same central axis such that the fluid may flow in a straight line until it reaches the connecting tubes of the feeder tube 400. Thus, the brush may feature low pressure loss due to the inexistence of bends in the line in which the fluid flows. Thus, a more precise amount of fluid is ejected from each of the ejection valves 40 from a movement of the actuator lever 50.

However, it is understood that bends in the line between the fluid container 110, pump tube 600, plunger 680 and flange tube 200 do not depart from the scope of the present invention. In addition, although it is described herein that the fluid flows in the same direction as the direction in which actuator lever 50 is moved, for example, when actuator lever 50 is moved toward pad 30 the fluid flows toward and out of ejection valves 40, the present invention is not limited thereto. For example, the fluid may be routed to flow toward and out of the ejection valves when the actuator lever is moved "backwards" or toward the cap 60. In this case, an additional element, hinged between the actuator lever and the bottom casing may be used such that a "backwards" movement of the actuator lever would move a first portion of the hinged element backward about the hinge, which then would cause a second portion of the hinged element to move forward about the hinge. The hinge may be located between or at the junction of the first and second portions of the additional element. Thus, the second portion of the hinged element, which moves forward, would be connected to the plunger cover to move the plunger cover together with the plunger 680 forward. However, it is understood that other mechanisms may be used to actuate a precise and controlled amount of fluid flow through the ejection valves without departing from the scope of the present invention.

In FIGS. 8, 9 and 10 it is illustrated that the flange tube 200 is a separate part disposed between plunger 680 and feeder tube 400. According to an exemplary embodiment of the present invention, the feeder tube 400 and the flange tube 200 may be manufactured as one integral and continuous structure (i.e., one piece).

With regard to the fluids that may be maintained in fluid reservoir 110, it should be appreciated and understood, that the term fluid as used herein is intended to be used in a broad sense to refer to all forms of fluid used in connection with hair care and treatment, including without limitation, gels, serums, elixirs, dyes, conditioners, shampoos, water and the like. Since the ejection valves 40 are disposed on the pad 30, they are less susceptible to blockage of flow resulting from ejection valves being disposed on the tips of the bristles since the ejection valves 40 are not in contact with the scalp or skin. In addition, the placement of the ejection valves 40 on the pad 30 increases the spreadability of the fluid in a user's hair since the fluid travels most directly to the hair, instead of being dispensed on skin.

In an exemplary embodiment of the present invention, thumb press 54 may be located in the back of the brush. In this case, the bottom casing 20 includes an opening from which the thumb press 54 may protrude. Thus, in an exemplary embodiment of the present invention, the housing of the actuator lever 50 is disposed between the bottom casing 20 and the pump tube 600. The holes 52 are coupled to respective bosses 740 of the plunger cover 720 to connect the actuator lever 50 to the plunger 720. Thus, the plunger cover 720 connects the plunger 680 to the actuator lever 50. In this case, the molding 26 may be kept in place, modified to accommodate the opening of the bottom casing 20 and the actuator lever 50, relocated on the top casing 10, etc. When the thumb press 54 is located in the back of the brush, the fluid dispensing mechanism may be configured to outflow the fluid from the one or more ejection valves 40 when the actuator lever 50 is moved from a first position (closer to the lid 70) to a second position (distant from the lid 70).

Elements of the brush having thumb press 54 protruding from bottom casing 20 which are not described herein may be assumed to be similar to corresponding elements of the brush having the thumb press protruding from the top casing 10.

When thumb press 54 protrudes from bottom casing 20, a hinged element may be used to outflow the fluid from the one or more ejection valves 40 when the actuator lever 50 is moved "backward" from the second position (distant to the lid 70) to the first position (closer to the lid 70). The hinged element may be connected to actuator lever 50 and to plunger cover 720, and may be hinged between actuator lever 50 and plunger cover 720. Thus, when a first portion of the hinged element moves "backward", a second portion of the hinged element moves forward (e.g., in a direction from the lid 70 toward the pad 30). The first and second portions of the hinged element rotate about the hinge.

However, actuator lever 50 can be adapted to move in other directions to eject the fluid from the at least one ejection valve 40. For example, actuator lever 50 can be adapted to be moved from left to right, right to left, or other directions.

The accompanying specification and drawings only illustrate an exemplary embodiment of a fluid dispensing brush and applicator device, its constituent parts, and associated methods and processes. However, other exemplary embodiments are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A brush, comprising:

a first casing having a first opening;

a second casing engaged to said first casing and together defining an interior space and a handle;

a pad positioned at said first opening of said first casing;

a plurality of bristles located at said pad;

a fluid reservoir positioned in said interior space;

a pump assembly positioned in said interior space and fluidly connected at a distal end thereof to said fluid reservoir;

a piping array positioned in said interior space and fluidly connected to said pump assembly;

a plurality of ejection valves fluidly connected to said piping array and positioned on said pad among said plurality of bristles;

an actuator lever adapted to be operated by a user and moved between a first position and a second position, said actuator lever connected to said pump assembly to move and dispense fluid through said plurality of ejection valves; and wherein, when said actuator lever is moved from said first position to said second position, fluid in said fluid reservoir is suctioned from said fluid reservoir.

2. The brush of claim 1, wherein said fluid reservoir, pump assembly, piping array and plurality of ejection valves are in airtight connection with one another to hinder fluid therein from evaporating or drying.

3. The brush of claim 2, said pump assembly comprising a pump cylinder tube having a first end, a second end and a hollow member, a valve disposed interior of said pump tube and a pump tube cylinder cover.

4. The brush of claim 3, said pump assembly further comprising a plunger disposed within said pump cylinder tube and a plunger cover.

5. The brush of claim 4, wherein said plunger is configured to move within the said pump cylinder tube when the actuator lever moves to said first position and said second position.

6. The brush of claim 5, wherein said plunger cover comprises a pair of bosses, wherein said actuator lever is attached to said plunger cover via said bosses to move said plunger within said pump cylinder tube.

7. The brush of claim 6, wherein said pump assembly is held in place in a molding in said second casing.

8. The brush of claim 1, further comprising a pressure cap in said fluid reservoir, wherein when said fluid is pumped from said fluid reservoir, said pressure cap moves toward said piping array.

9. The brush of claim 1, wherein each of said plurality of bristles have a shaft with a polygonal cross-section.

10. The brush of claim 9, wherein each of said plurality of bristles have a hexagonal pyramid tip.

11. A brush, comprising:

a housing, having a first section and a second section, said housing defining an interior space and a handle area at said first section;

an airtight fluid dispensing mechanism disposed within said interior space of said housing, said airtight fluid dispensing mechanism comprising a fluid reservoir, a pump assembly, a feeder tube, and a plurality of ejection valves;

an actuator, said actuator being connected to said pump assembly and adapted to pump fluid from said fluid reservoir to said ejection valve via said feeder tube;

a plurality of bristles disposed at said second section of said housing, said bristles having a shaft with a polygonal cross section;

wherein said fluid reservoir is disposed in said interior space at said handle area of said housing; and wherein said fluid reservoir, said pump assembly, said feeder tube, and said plurality of ejection valves are in airtight fluid connection with one another to enable movement and dispensing of fluid from said fluid reservoir to said plurality of ejection valves.

12. The brush of claim 11, wherein said plurality of ejection valves each comprise an airtight, one-way, duckbill valve.

13. The brush of claim 11, wherein said feeder tube comprises an inlet and a plurality of outlets, wherein each outlet leads to one of said plurality of ejection valves.

14. The brush of claim 11, wherein said pump assembly comprises a pump cylinder tube, a flange tube and a plunger.

15. The brush of claim 11, wherein said fluid dispensing mechanism further comprises a flange tube disposed between said feeder tube and said pump assembly.

16. The brush of claim 15, wherein said flange tube and said pump cylinder tube are held stationary in said housing, and said plunger is adapted to within said pump cylinder tube to move fluid from said fluid reservoir to said feeder tube.

17. A brush, comprising:

a housing having a first opening, second opening and third opening and defining a first interior chamber, a second interior chamber and a handle;

a pad positioned at said first opening;

a plurality of polygonal-sided bristles located at said pad;

a fluid reservoir positioned in said first interior chamber;

a cover to maintain said fluid reservoir in said first interior chamber;

a pump assembly positioned in said second interior chamber and fluidly connected at a distal end thereof to said fluid reservoir;

a piping array having an inlet, a plurality of outlets and a main distribution line, said piping array positioned in said second interior chamber and fluidly connected to said pump assembly via said inlet;

a plurality of ejection valves fluidly connected to said piping array via said plurality of outlets and positioned on said pad;

an actuator lever adapted to be operated by a user and moved between a first position and a second position, said actuator lever connected to said pump assembly to move and dispense fluid through said plurality of ejection valves; and wherein, when said actuator lever is moved from said first position to said second position, fluid in said fluid reservoir is suctioned from said fluid reservoir.

18. The brush of claim 17, wherein said piping array comprises five asymmetrically positioned pipes that each lead to one of said plurality of ejection valves.

19. The brush of claim 17, wherein each of said plurality of ejection valves is formed of silicone.

20. The brush of claim 17, wherein fluid from said fluid reservoir moves along a common axis when it travels from said fluid reservoir, to said pump cylinder tube, and to said main distribution line.

* * * * *